US011192715B2

(12) United States Patent
Airy et al.

(10) Patent No.: US 11,192,715 B2
(45) Date of Patent: Dec. 7, 2021

(54) ANTI-SPLASH VOMIT RECEPTACLE

(71) Applicant: Puke Bucket LLC, Denver, CO (US)

(72) Inventors: William O. Airy, Greenwood Village, CO (US); Leanne Katherine Airy, Greenwood Village, CO (US)

(73) Assignee: Puke Bucket LLC, Denver, CO (US)

( * ) Notice: Subject to any disclaimer, the term of this patent is extended or adjusted under 35 U.S.C. 154(b) by 245 days.

(21) Appl. No.: 16/394,872

(22) Filed: Apr. 25, 2019

(65) Prior Publication Data

US 2019/0329975 A1 Oct. 31, 2019

Related U.S. Application Data

(60) Provisional application No. 62/662,318, filed on Apr. 25, 2018.

(51) Int. Cl.

| | |
|---|---|
| ***B65F 1/08*** | (2006.01) |
| ***A61J 19/00*** | (2006.01) |
| ***B65F 1/14*** | (2006.01) |

(52) U.S. Cl.

CPC ..... *B65F 1/08* (2013.01); *A61J 19/00* (2013.01); *B65F 1/1452* (2013.01); *B65F 2240/172* (2013.01)

(58) Field of Classification Search

CPC ..... A61J 19/00; B65F 1/08; B65F 2240/172; B65F 1/1468; B65F 1/02; B67D 7/421; A61B 10/007; A61B 10/0051

See application file for complete search history.

(56) References Cited

U.S. PATENT DOCUMENTS 709,165 A * 9/1902 Lindsay ..... A61J 19/00 4/258
1,160,553 A * 11/1915 Whalen ..... A61J 19/00 4/283

(Continued)

FOREIGN PATENT DOCUMENTS

FR 2697423 A1 * 5/1994 ..... A47J 47/20
JP H07330102 A * 12/1995 ..... A61L 9/015

*Primary Examiner* — Susan S Su
*Assistant Examiner* — Eric Rassavong
(74) *Attorney, Agent, or Firm* — Hall Estill Law Firm

(57) ABSTRACT

Disclosed is a bucket for receiving oral wastes of a user. The bucket includes a container and an Anti-splash back apparatus. The container receives the oral wastes of the user. The container incorporates a base and a container wall extending upward from the base, said container wall having an inner surface and an outer surface. The container incorporates an open top for receiving the oral wastes of the user. The Anti-splash back apparatus during intended usage is intended to maintain the oral wastes within the container. The Anti-splash back apparatus includes a first blade and a second base, both configured within the inner surface of the container sidewall. The first blade extends across the voluminous void of the container at an acute angle from the base meeting the inner surface of the container sidewall. The second blade extends across the voluminous void of the container at an obtuse angle from the base within the container sidewall. The first blade and the second blade are configured to extend along a path substantially parallel to the base. The first blade and the second blade intersect to form an Anti-splash back apparatus. Further, the bucket includes plurality of handles attached to outer surface of the container wall, which during intended usage allows the user to easily hold the container.

9 Claims, 5 Drawing Sheets

(56) References Cited

U.S. PATENT DOCUMENTS

| | | | | |
|---|---|---|---|---|
| 7,029,463 | B1 * | 4/2006 | Estudillo | A61J 19/00 604/317 |
| 2003/0116575 | A1 * | 6/2003 | Ellingson | A61G 9/003 220/719 |
| 2005/0070864 | A1 * | 3/2005 | Fellion | A61J 19/00 604/346 |
| 2018/0072462 | A1 * | 3/2018 | Schlueter | B65F 1/16 |

* cited by examiner

FIG. 5D
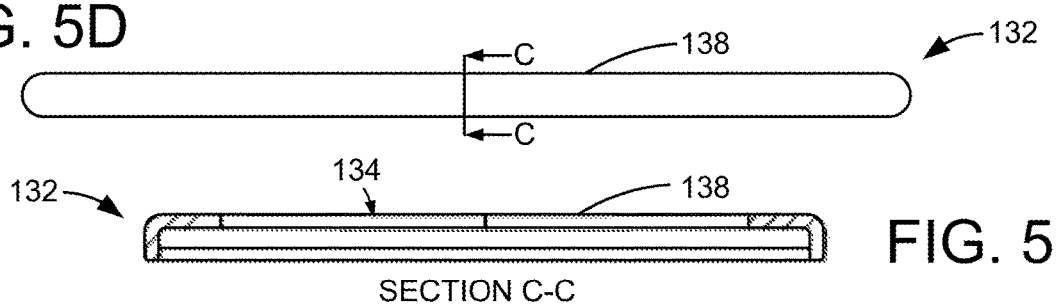
FIG. 5C
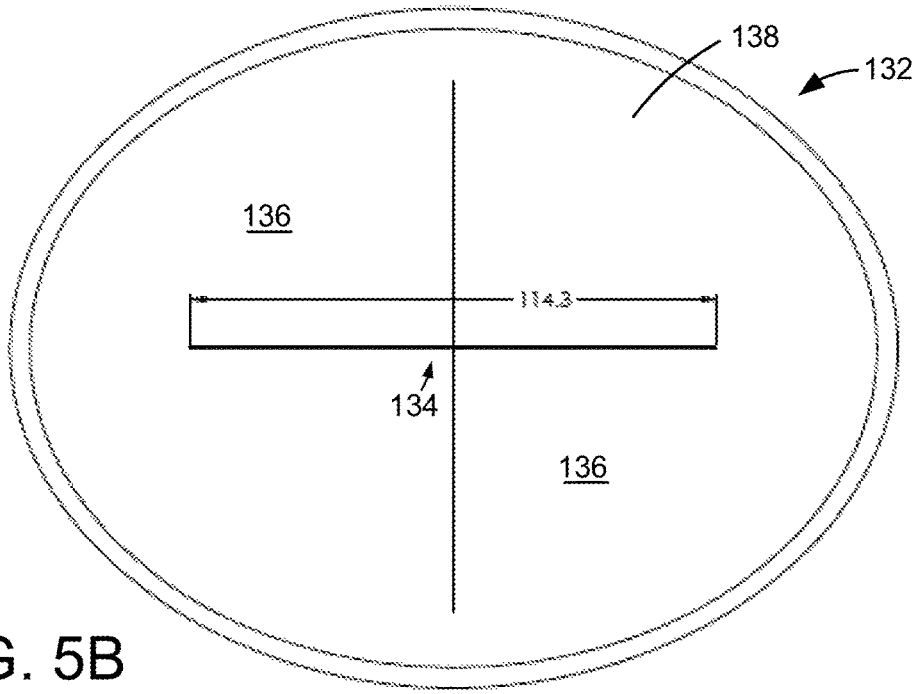
FIG. 5B
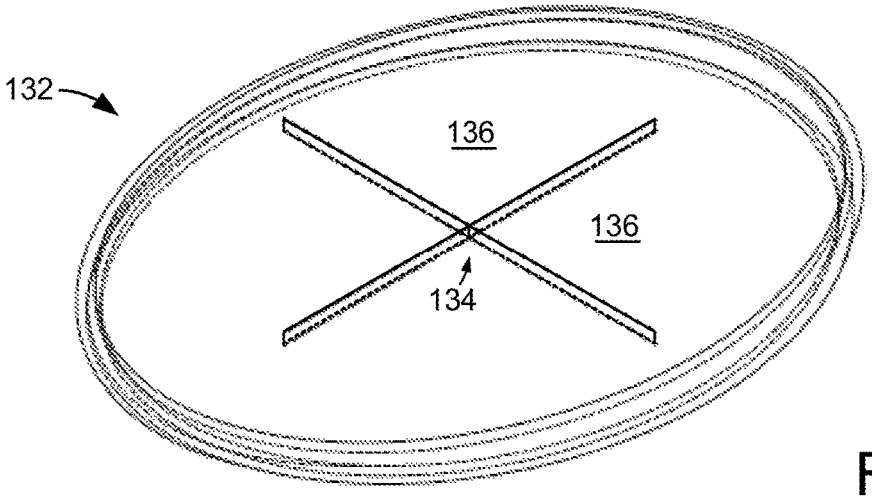
FIG. 5A

ANTI-SPLASH VOMIT RECEPTACLE

CROSS-REFERENCE TO RELATED APPLICATIONS

This application claims benefit under 35 U.S.C. 119(e) of U.S. Provisional Application Ser. No. 62/662,318, filed Apr. 25, 2018, which is hereby expressly incorporated herein by reference in its entirety.

FIELD OF THE INVENTION

The present invention generally relates to a container for receiving oral waste of a user, and more particularly relates to a vomit receptacle for receiving and controlling the splashing of the oral waste within the receptacle or container.

BACKGROUND OF THE INVENTION

Nausea and vomiting are uncomfortable and often frequent experiences for young children and adults alike. Vomiting is a frightening and often painful experience for any child, but it is also a normal and expected element of childhood often occurring as a result of an illness or due to motion sickness. Vomiting also results from a variety of pathogen-inflicted illnesses and as a result of the consumption of disagreeable food or beverage.

When a child endures a period of vomiting, during such experiences, it is beneficial for the child to receive immediate comfort, security, and protection from the odorous and unpleasant fluids expelled. Parents also need confidence that the expelled stomach fluids will be safely contained, thereby protecting bedding, furniture and/or car interior from damage.

In most situations, children are often required to vomit into objects their parents can provide quickly and conveniently. Due to the oft-sudden onset of vomiting episodes, similar situations are encountered by adults, who often must vomit into whatever object is readily available. Unfortunately, such items frequently include food bowls, dishes, cups, garbage bags, plastic shopping bags, and even diapers. Besides being unsanitary, food bowls, dishes or cups are often cumbersome, heavy, too small, poorly shaped and/or breakable. Often, receptacles for vomit are unpleasant and/or difficult to clean.

Plastic bags and even air sickness bags are similarly cumbersome and prone to spilling or breaking and are often difficult for a child to operate. Further, adults and children alike may not feel comfortable throwing up into a bowl they know they may also eat from. When traveling by car, vomiting often begins before the driver can safely stop the car. This is a particularly difficult challenge for the parent-driver of a sick child passenger, who often must stop the car and unstrap the nauseated child from his or her safety seat. Moreover, prior art mechanisms are not well-designed to hang upon a fixed object in an environment near where a person is sick.

Plastic bags often would not allow for the repeated emptying or cleaning and thus have to be disposed of every time. Food bowls or other available containers in the market are not designed for use by sick people. Such objects are difficult to grasp. Moreover, the oral waste often escapes such objects during use by leaking or spilling or even splashing back on to the user after hitting the sidewalls.

Therefore, there is a need for a vomit receptacle having splash mitigation units to prevent escaping of the oral waste out of the receptacle during intended use. Further, a need exists for a vomit receptacle that includes plurality of handles to allow the user to easily grasp and hold the receptacle, particularly while facing the added challenge of being uncontrollably sick.

SUMMARY OF THE INVENTION

In accordance with teachings of the present disclosure, a receptacle for receiving oral wastes of a user, with grasping mechanisms, is disclosed.

An object of the present disclosure is to provide a container incorporating an anti-splash back apparatus. The container receives oral wastes of the user. The anti-splash back apparatus as further described herein operates to prevent oral wastes deposited into the container from escaping the container onto the user following and/or during an episode of vomiting. The container includes a base and a container wall extending upwards from the base having an inner surface and an outer surface. The container incorporates an open top for receiving the oral wastes of the user. During intended use, the anti-splash back apparatus maintains the oral wastes within the container.

The anti-splash back apparatus includes a first blade and a second blade. The first blade and the second blade both are configured within the inner surface of the container sidewall. The first blade and the second blade extending across the voluminous void of the container at an acute angle and the obtuse angle respectively from the base meeting the inner surface of the container sidewall. The first blade and the second blade is configured parallel to the base. The first blade and the second blade intersect to form a cross, comprising the main mass of the anti-splash back apparatus. In one embodiment of the invention, the anti-splash back apparatus is removable. A removable anti-splash back apparatus allows for easier cleaning of both the anti-splash back apparatus and the container.

Another object of the present disclosure is to provide a bucket-type container including a plurality of handles attached to the outer surface of the container wall for allowing the user to easily hold the container.

Another object of the present disclosure is to provide a container in the substantial form of a bucket incorporating an anti-splash back apparatus comprising two blades, with the acute angle of the first blade ranging between 70 degrees to 85 degrees relative to the base and the obtuse angle of the second blade ranging between 95 degrees to 130 degrees relative to the base.

BRIEF DESCRIPTION OF DRAWINGS

FIG. 5A is a perspective view of a lid for an anti-splash back apparatus of the bucket constructed in accordance with the present disclosure.

FIG. 5B is a top plan view of the lid shown in FIG. 5A constructed in accordance with the present disclosure.

FIG. 5C is a cross-sectional view of the lid constructed in accordance with the present disclosure.

FIG. 5D is a side elevation view of the lid constructed in accordance with the present disclosure.

DETAILED DESCRIPTION

Figure 1:
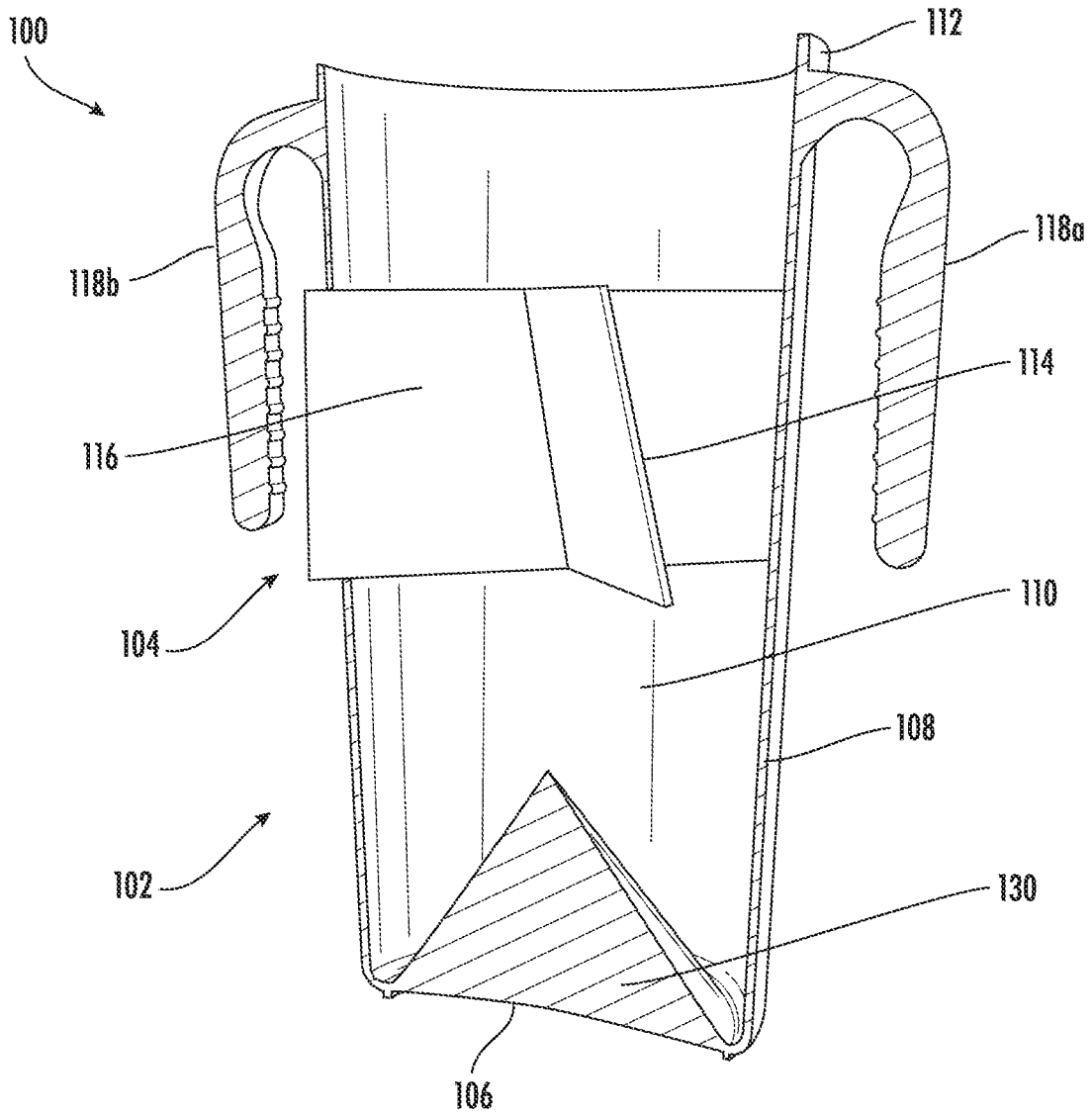
FIG. 1 illustrates a cross-sectional perspective view of a bucket constructed in accordance with the present disclosure.

While various embodiments are illustrated and described herein, a bucket for receiving and controlling the splashing of the oral waste may be produced in many more configurations, forms, and with various materials. Various embodiments of the disclosure are depicted in the drawings and are described in detail herein, with the understanding that the present disclosure is to be considered as an exemplification of the principles of the invention and the associated functional specifications for its construction. The present disclosure is not intended to limit the invention merely to the embodiments illustrated and/or described. Those skilled in the art will envision many other possible variations within the scope of the technology described herein.

FIG. 1 illustrates a cross-sectional perspective view of a bucket 100 for receiving oral wastes of a user in accordance with the present disclosure. The bucket 100 includes a container 102 for holding the oral wastes of the user and an Anti-splash back apparatus 104 for maintaining the oral wastes in the container 102. The container 102 incorporates a base 106 and a container sidewall 108 extending upwards from the base 106 having an inner surface 110 and an outer surface 112.

Figure 2:
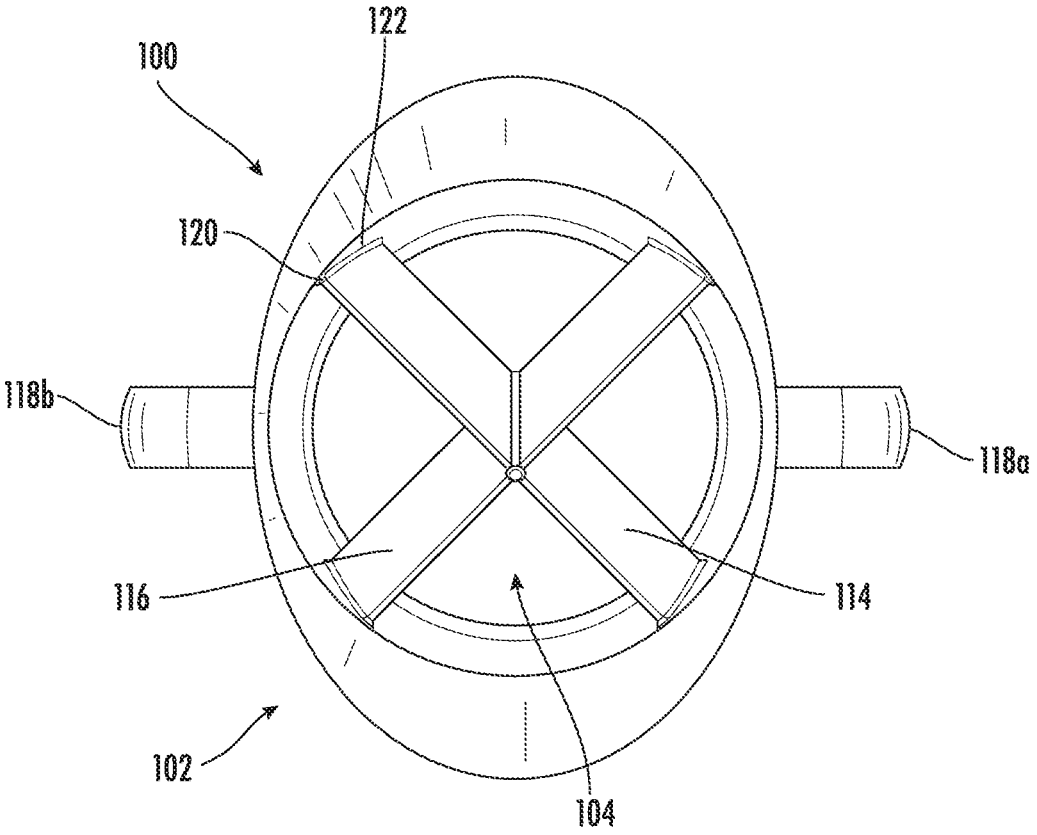
FIG. 2 illustrates a top view of the bucket constructed in accordance with the present disclosure.

The container 102 incorporates an open top (202 shown in FIG. 2) for receiving the oral wastes of the user. During intended use, the Anti-splash back apparatus 104 maintains the oral wastes within the container 102. In one embodiment shown in FIG. 2, the anti-splash back apparatus 104 includes a first blade 114 and a second blade 116. The first blade 114 is configured within the container 102.

The first blade 114 traverses across the voluminous void of the container at an acute angle relative to the base 106 meeting the inner surface 110 of the container sidewall 108. The first blade 114 is configured to extend along a path substantially parallel to the base 106. The second blade 116 is configured and positioned to extend from one side of the inner surface 110 to the other side of the inner surface 110 of the container sidewall 108 to intersect the first blade 114. The second blade 116 traverses across the voluminous void of the container at an obtuse angle relative to the base 106 within the container sidewall 108.

The second blade 116 is configured to extend along a path substantially parallel to the base 106. The first blade 114 and the second blade 116 intersect. This intersection creates a unification of the blades wherein the first blade 114 and the second blade 116 form an Anti-splash back apparatus 104. The first blade 114, the second blade 116 and the container 102 can be comprised primarily or exclusively of non-hygroscopic, recyclable material, including but not limited to Polyethylene or Polypropylene. While these materials are cost effective during large injection molding manufacturing processes, other materials can be used such that the bucket 100 performs as described herein.

In one embodiment of the present disclosure, the acute angle of the first blade 114 is about 76.75 degrees relative to the base 106. In another embodiment, the acute angle of the first blade 114 may range at any angle between about 70 degrees to about 85 degrees relative to the base 106. Further, in yet another embodiment, the obtuse angle of the second blade 116 is about 103.25 degrees. In a further embodiment, the obtuse angle of the second blade 116 ranges between about 95 degrees to about 130 degrees relative to the base 106.

In another embodiment of the present disclosure, the ends of first blade 114 and second blade 116 coming into contact with the inner surface 110 of the container sidewall 108 of the container 102 contain notches 120. In such embodiments, the inner surface 110 of the container sidewall 108 of the container 102 incorporates ridges 122 designed to interact with the notches 120 of the ends of the first blade 114 and second blade 116 to accommodate holding the anti-splash back apparatus 104 in place within the container 102.

In a further embodiment of the present disclosure, the bucket 100 further includes a plurality of handles 118*a*, 118*b* attached to outer surface 112 of the container sidewall 108. A plurality of handles facilitates grip by a human hand, enabling the user to easily hold the container 102. It would be readily apparent to those skilled in the art that various shapes, materials and sizes of the handles 118*a*, 118*b* may be envisioned without deviating from the scope of the present disclosure.

In an exemplary embodiment of the present disclosure, the height of the container 102 is 264.3 mm, the width of the container 102 is 212.7 mm, the width of the handle 118*a*, 118*b* is 22.2 mm. However, it would be readily apparent to those skilled in the art that the bucket 100 may be constructed in various shapes and sizes in alternate embodiments of the present disclosure without deviating from the scope of the present disclosure.

Figure 3:
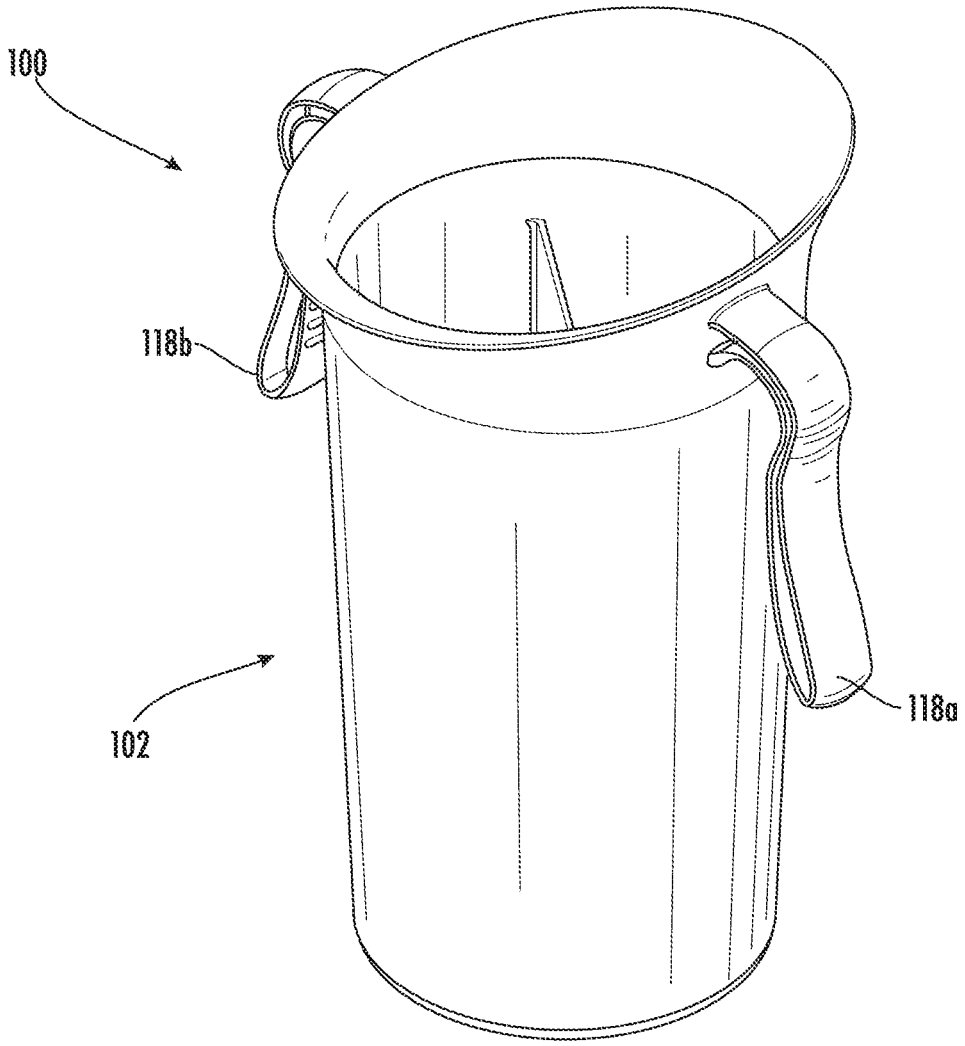
FIG. 3 illustrates a side view of the bucket constructed in accordance with the present disclosure.

FIG. 3 illustrates a side view of the bucket 100 in accordance with one embodiment of the present disclosure. In this embodiment, the container 102 is cylindrically shaped. However, it would be readily apparent to those skilled in the art that various shapes of the container 102 may be envisioned without deviating from the scope of the present disclosure.

Figure 4A:
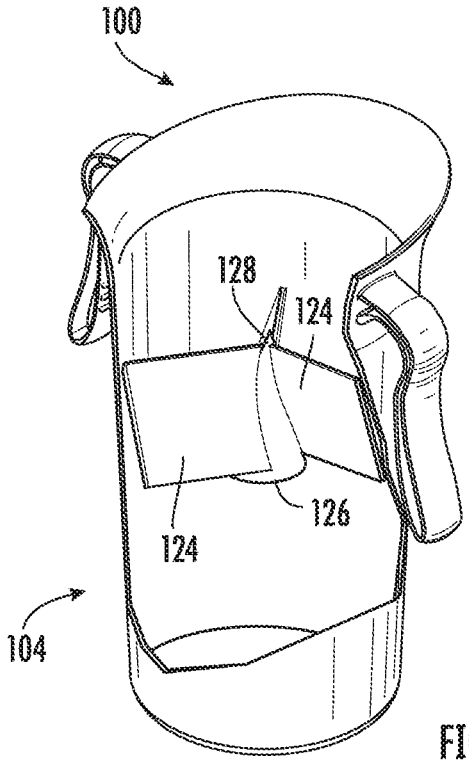
FIG. 4A is a perspective view of an anti-splash back apparatus of the bucket constructed in accordance with the present disclosure.
Figure 4B:
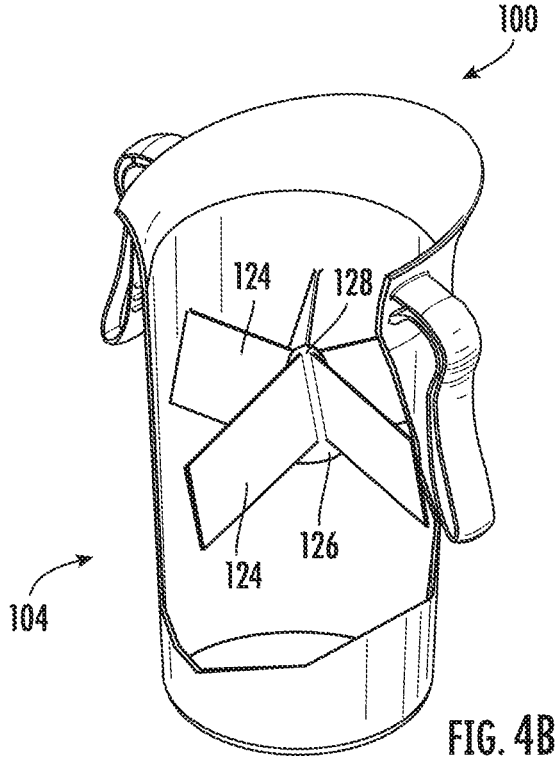
FIG. 4B is a perspective view of another embodiment of the anti-splash back apparatus of the bucket constructed in accordance with the present disclosure.
Figure 4C:
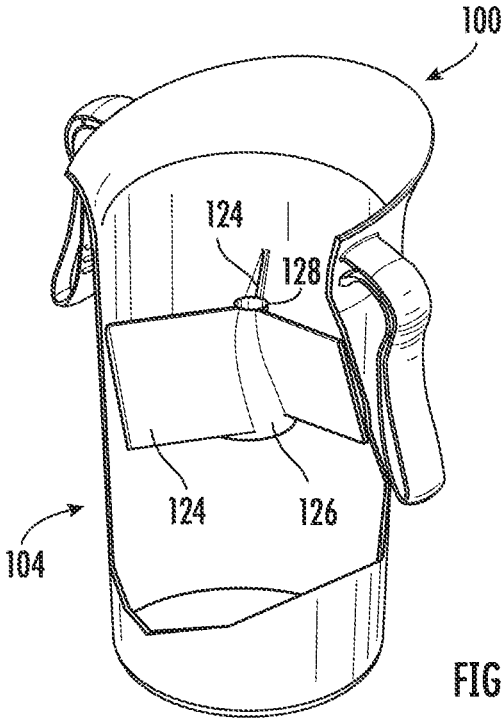
FIG. 4C is a perspective view of yet another embodiment of the anti-splash back apparatus of the bucket constructed in accordance with the present disclosure.
Figure 4D:
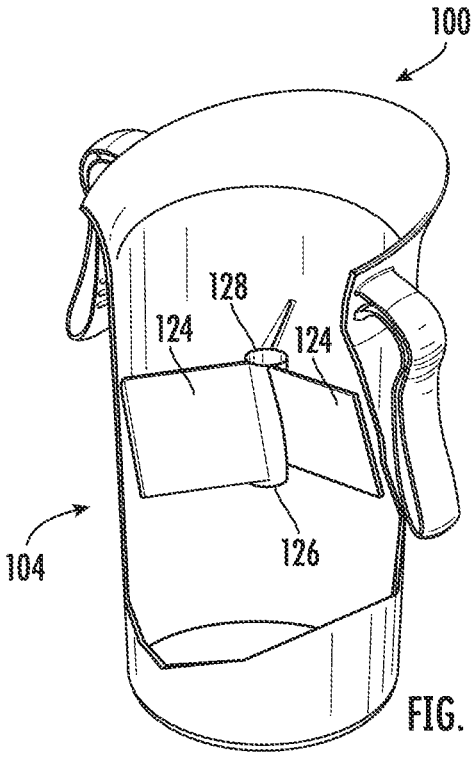
FIG. 4D is a perspective view of a further embodiment of the anti-splash back apparatus of the bucket constructed in accordance with the present disclosure.

Further embodiments of the present disclosure are shown in FIGS. 4A-4D. In these embodiments the anti-splash back apparatus 104 can include a plurality of fins 124 that extend from the inner surface 110 to a hub element 126. The fins 124 can be spaced substantially equally apart from each other around the hub element 126 or the fins 124 can be unequally spaced apart from each other around the hub element 126. The embodiment shown in FIG. 4A depicts a bucket 100 that includes three fins 124 and the embodiment shown in FIG. 4B depicts a bucket 100 that includes five fins. It should be understood and appreciated that the bucket 100 could have any number of fins 124 such that the bucket 100 is capable of performing as intended.

Similar to the blades 114 and 116 discussed herein, the fins 124 can also be angled relative to the base 106 of the bucket 100. Depending on perspective, the fins 124 can be angled relative to the base 106 in a range of from about 50 degrees to about 130 degrees. Said another way, the fins 124 can be angled relative to a vertically disposed centerline in the bucket 100 in a range of from about 0 degrees to about 40 degrees. In one embodiment, all fins 124 of the bucket 100 can be oriented similarly and have essentially the same angle relative to the base 106 of the bucket 100. In another embodiment, the fins 124 can have different angles relative to the base 106 or vertical centerline of the bucket 100.

The hub 126 can be sized and shaped in any manner such that the bucket 100 operates as intended. In one embodiment, the hub 126 is conical-shaped. The conical-shaped hub 126 can have a pointed top portion 128 or a rounded top portion 128. In another embodiment, the conical-shaped hub 126 can be hollow and open at the top end 128. In another embodiment, the hub 126 can be cylindrically-shaped and be hollow.

In yet another embodiment of the present disclosure, the bucket 100 can include a diverter element 130 disposed on the base 106 of the bucket 100 to direct fluids entering the bucket 100 away from the base 106. The diverter element 130 can be conical-shaped where the angled sides of the diverter element 130 direct fluids that enter the bucket 100 towards the inner surface 110 of the container sidewall 108.

In a further embodiment of the present disclosure shown in FIGS. 5A-5D, the bucket 100 can be provided with a lid 132 designed to fit the oval shape of the top of the bucket 100. The lid 132 can be secured to the top of the bucket 100 by frictional engagement, threaded or by some other manner known in the art by one of ordinary skill in the art. The lid can have a slit 134 disposed therein to provide flexible portions 136. In one embodiment, the slit 134 can be cross shaped, which would create 4 flexible portions 136 in the lid. The slit 134 and flexible portions 136 cooperate to permit a user to press their face into an outer side 138 of the lid 132, which flexes the flexible portions 136 inward and creates an opening large enough for the user's mouth to be in fluidic communication with the internal portions of the bucket 100. The user can vomit through this opening into the bucket and the flexible portions 136 of the lid 132 protect the user's face and prevent the vomit from splashing out of the bucket 100.

In another embodiment of the present disclosure, the anti-splash back apparatus 104 can be removed from the bucket 100 and a bag can be secured to an upper part of the outer surface 112 of the container sidewall 108 and extend down into the bucket 100. The bag can be secured to the bucket 100 via any manner known in the art. For example, the bag could be secured to the bucket via adhesive material or an elastic material built into a portion of the bag.

Embodiments of the present disclosure offer various advantages over prior art solutions. Such advantages include the improved maintenance and containment of oral wastes within the container wall while a user vomits into the container. The present disclosure further helps users who are sick, inebriated, young or partially incapacitated more easily dispose of their oral wastes in a manner that minimizes the splash of the oral wastes back on to their clothes or face. Further, the present disclosure includes handles to help the users who are sick, inebriated, young or partially incapacitated to hold the container closer to the mouth. In an embodiment, the handles are curved as depicted in FIG. 1. The present disclosure has recognized that the curved nature of the handles in an embodiment better accommodate users who have larger hands, and also more easily allow for the handles to facilitate hanging of the embodiment upon fixed structures, such as upon a handrail, bedrail or headboard of beds or similar objects, especially while in an environment near where a person is sick. The configuration of the Anti-Splash Back Vomit Receptacle, including the dimensions of the various embodiments, along with the nature and placement of the handles, especially facilitates use by a user with long hair. In particular, the configurations of various embodiments herein feature dimensions corresponding to a human face. Resultantly, a person with long hair is protected from hair falling into the opening of the Anti-Splash Back Vomit Receptacle.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential feature or element of any or all the claims. The invention is defined solely by the appended claims, including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing", or any other variation thereof, are intended to cover a non-exclusive inclusion, such that a process, method, article, or apparatus that comprises, has, includes, contains a list of elements does not include only those elements, but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more, unless explicitly stated otherwise herein. The terms "substantially", "essentially", "approximately", "about", or any other version thereof, are defined as being close to as understood by one of ordinary skill in the art. The terms "coupled" and "linked" as used herein is defined as connected, although not necessarily directly and not necessarily mechanically. A device or structure that is "configured" in a certain way is configured in at least that way, but may also be configured in ways that are not listed. Also, the sequence of steps in a flow diagram or elements in the claims, even when preceded by a letter does not imply or require that sequence.

The invention claimed is:

1. A bucket for receiving oral wastes of a user, the bucket comprising:

a container, comprising:

a base;

a container sidewall extending upwards from the base, said container wall comprising an inner surface and an outer surface;

an open top; and an anti-splash back apparatus, the anti-splash back apparatus further comprising:

a first blade attached on each end to an inner surface of the container sidewall, the first blade extending across the voluminous void of the container at an acute angle relative to the base of the container;

a second blade attached on each end to the inner surface of the container sidewall and configured to intersect the first blade within the voluminous void of the container, the second blade extending across the voluminous void of the container across at an obtuse angle relative to the base within the container sidewall; and wherein the first blade and the second blade intersect.

2. The bucket of claim 1, wherein the anti-splash back apparatus is removable.

3. The bucket of claim 1, further comprising a plurality of handles attached to the outer surface of the container sidewall.

4. The bucket of claim 1, wherein the acute angle of the first blade ranges between about 70 degrees to about 85 degrees relative to the base.

5. The bucket of claim 1, wherein the obtuse angle of the second blade ranges between 95 degrees to 130 degrees relative to the base.

6. The bucket of claim 1, wherein a diverter element is disposed on the base of the container to direct fluids projected into the container toward the inner surface of the sidewall container.

7. The bucket of claim 1, further includes a bag that extends at least partially down into the bucket.

8. The bucket of claim 7 wherein the bag is secured to an outer surface of a container sidewall of the bucket.

9. The bucket of claim 8 wherein the bag is secured to the outer surface of the container sidewall of the bucket via an adhesive material or an elastic material.

* * * * *